United States Patent [19]

Wills

[11] Patent Number: 4,580,422

[45] Date of Patent: Apr. 8, 1986

[54] REPLACEABLE BANKNOTE CASSETTE FOR AN AUTOTELLER

[75] Inventor: Graham L. Wills, South Croydon, England

[73] Assignee: Burroughs Corporation, Detroit, Mich.

[21] Appl. No.: 576,246

[22] Filed: Feb. 2, 1984

[30] Foreign Application Priority Data

Mar. 16, 1983 [GB] United Kingdom ..... 8307206

[51] Int. Cl.[4] ..... E05B 65/52

[52] U.S. Cl. ..... 70/63

[58] Field of Search ..... 70/63; 221/154, 197, 221/287; 232/10, 44

[56] References Cited

U.S. PATENT DOCUMENTS

| | | | |
|---|---|---|---|
| 3,693,870 | 9/1972 | Dominick . | |
| 3,773,252 | 11/1973 | Jensen . | |
| 4,339,221 | 7/1982 | Mitzel | 221/154 |
| 4,434,931 | 3/1984 | Hunt . | |

FOREIGN PATENT DOCUMENTS

| | | | |
|---|---|---|---|
| 596310 | 5/1934 | Fed. Rep. of Germany . | |
| 2378322 | 8/1978 | France . | |
| 2443396 | 7/1980 | France . | |
| 8004676 | 8/1980 | Netherlands | 70/63 |
| 807880 | 1/1959 | United Kingdom . | |
| 911149 | 11/1962 | United Kingdom . | |
| 970888 | 9/1964 | United Kingdom . | |
| 2039264 | 8/1980 | United Kingdom . | |
| 2079846 | 1/1982 | United Kingdom . | |
| 2121472 | 12/1983 | United Kingdom . | |
| 2131082 | 6/1984 | United Kingdom | 70/63 |

*Primary Examiner*—Robert L. Wolfe

*Attorney, Agent, or Firm*—Mark T. Starr; Kevin R. Peterson

[57] ABSTRACT

A cassette for providing dispensable banknotes in an autoteller is characterized by its door being able to be slid open on only one occasion after a lock has been primed, the act of opening being achieved only inside the autoteller upon seating the cassette on the correct key. The mechanism of the lock is characterized by comprising a rotating plate which can be moved from a locked to an open position when the key aligns rotation-opposing pins with rotation-permitting channels, the rotating plate being controlled to open only once by a primed rotating catch falling into a position to prevent further opening of the lock and door whenever the door is next closed.

20 Claims, 13 Drawing Figures

REPLACEABLE BANKNOTE CASSETTE FOR AN AUTOTELLER

BACKGROUND TO THE INVENTION

1. Field of the Invention

The present invention relates to automatic banknote-dispensing equipment for use in providing paper money to a user. More particularly, the present invention relates to such a dispenser used as an autoteller, in particular outside normal banking hours and providing a service in the absence of banking staff. In greatest particularity, the present invention relates to tamperproof paper money cassettes for use in a banknote dispenser which can be changed by persons other than employees of the bank and which provide a measure of protection against interference with the contents.

2. The Prior Art

Autoteller systems are available for use by bank customers outside normal banking hours. Access is provided to the equipment at some point external to the bank and money, generally paper money, is provided to the user upon presentation to the autoteller of a valid user card and the further provision to the autoteller via a keyboard of further, secret information known only to the true owner of the card validating his or her right to its use.

Such use of autotellers has become extensive, and it has reached a point where, for some banks, most transactions with normal, domestic account holders are carried out via such equipment. The availability of access to the bank at all hours of the day has resulted in an improved service.

An autoteller can only function so long as it contains sufficient money to meet the demands of the users. The autoteller is loaded by the bank staff with a sum of money anticipated to be at least as large as the total required by the customers up to the next convenient time of loading. However, statistical variations in demand, together with other factors such as bank holidays and unusually high demand at certain times of the year such as Christmas and the time of the annual summer vacation, mean that it is not always possible to load the autoteller with enough money to maintain it in operation until the next loading time.

Accordingly, it is a desirable feature of an autoteller system that it can be loaded with money outside banking hours by persons other than employees of the bank.

In order to load an autoteller in such a manner it is necessary to provide an exchangeable banknote cassette which can be filled with money by bank staff during normal banking hours and entrusted, for example, to a security company, for one of the security company's operatives to change with the exhausted or part-exhausted cassette in the autoteller at some predetermined time or whenever the autoteller ceases to operate due to lack of funds.

There is a certain amount of risk entailed in such a system. The security company operative might not have the same level of skill and experience with the autoteller as the normal bank staff and accordingly might load a cassette filled with banknotes of one denomination into a position intended for a cassette loaded with banknotes of another denomination. If this should occur, either the customers will receive too little money and be dissatisfied with the service of the bank or the autoteller will pay out more than the amount demanded and accounted for to the ultimate financial loss of the bank. It is therefore a desirable feature of a cassette that it cannot be loaded into the wrong position in an autoteller.

Another risk arises from the security personnel themselves. A cassette full of money is an obvious temptation and it would be all too easy for a security company operative of fraudulent intent, not subject to the large amount of scrutiny experienced by banking staff during their working day, to remove some or all of the contents of the cassette with the possibility of blaming any subsequently discovered loss upon a malfunction of the autoteller.

It is therefore desirable to provide a cassette which cannot be opened other than at the autoteller itself and which will provide no access to the money even when so opened, so far as the person loading the cassette into the autoteller is concerned.

As earlier stated, sometimes the security company operative can be required to change a part-full cassette for a new one. The same argument applies to the part-full cassette as applies to the fresh cassette. It is therefore desirable that a cassette be provided wherein access is denied to the residual contents thereof subsequently to its removal from the autoteller.

One operative may be required to exchange the cassettes in many different autotellers. For the maintenance of correct accounting procedures and for the prevention of possible fraud it is desirable to provide a cassette which cannot be swapped around between autotellers and which cannot repeatedly be used.

SUMMARY OF THE INVENTION

Accordingly, the present invention consists in a cassette for loading banknotes into a banknote dispenser, said cassette including a door, openable to allow said dispenser access to a stack of banknotes, said door including a primable lock for holding closed said door, said lock, having been primed, being presentable to a key in said dispenser to allow said door to be opened, said lock, upon withdrawal from said key, being operably to prevent said door from being opened, and said lock allowing said door to be opened on only one occasion after each instance of priming, said cassette being characterised by said key being a selected one from among a plurality of different keys and by said lock being operable to allow said opening of said door only upon presentation to said selected key.

BRIEF DESCRIPTION OF THE PREFERRED EMBODIMENT

In a preferred embodiment a cassette preferably comprises a box for holding a stack of banknotes against an opening closed by a door. The banknotes are preferably urged towards the opening by means of a spring-loaded shoe. The door preferably slides at a right angle to the direction in which the banknotes are urged. A handle is preferably provided for transporting the cassette. In operation the door preferably slides up towards the face of the box whereon the handle is situated. A lock is preferably provided on the door for allowing the door to slide or not dependently upon whether the lock is open or closed.

The door is preferably constrained in its movements in the preferred direction by sliders on the end of the box adjacent the opening. The lock is preferably protected by a lock cover from being tampered with. The lock cover is preferably on the outside of the door.

The box is preferably provided with a lock-driving pin on the end of the box proximate to the opening for engaging the lock mechanism as the door is urged towards the open position and to operate the lock if and only if the other criterea for opening are met. The lock-driving pin preferably engages the lock mechanism to close the lock as the door slides back into the closed position.

The door preferably comprises an upper protective lip proximate the handle side of the box to prevent access to those parts of the lock mechanism housed within the door.

The cassette preferably comprises a reset pin on the end of the box proximate to and below the housing to engage a locking block for controlling the transverse position of a locking pin 36. The door preferably comprises a lower protective lip for preventing interference from below with those parts of the lock mechanism housed within the door.

The lock cover preferably forms a void against the door for the insertion therein of a key. The lock cover preferably comprises a lock cover protective lip for preventing access to those parts of the lock mechanism between the door and the lock cover.

In use the cassette is preferably lowerable onto the key. The key is preferably above a money conveyor. The key preferably is insertable into the void through the lowering of the box. The key preferably engages the lock mechanism in the void to open the box if and only if it has not already been opened. As the door engages the key with the lock opened the key preferably retains the door in a fixed position allowing the continued lowering of the box such that the money conveyor engages the first banknote in the stack of money through the opening, the continued lowering being through the sliding of the door against the box.

The key preferably comprises a first key platform at a first height above its base, a second key platform at a second height above its base and a third key platform at a third height above its base. A cutaway is preferably provided beneath the first key platform for receiving the locking pin. The cutaway preferably comprises a holding surface for the locking pin to retain the key in the lock when the door is open. The key is preferably immovably affixed to a bracket within the autoteller. A key lip is preferably provided for the support of the door as the box is lowered when the door is open and for defining the extent of ingress of the key into the void.

The door preferably comprises a main plate wherein are preferably provided a first main plate key slot, a second main plate key slot, and a third main plate key slot extensive in the direction of sliding of the door. The main plate preferably also includes a locking pin slot for allowing a limited travel of the locking pin in a direction transverse to the direction of sliding of the door. The main plate preferably also comprises a locking block channel communicating with the lower edge of the main plate to allow a predetermined amount of movement of the locking block in the direction of sliding of the door and to allow access to the locking block of the reset pin. The main plate is also preferably provided with a first pivot point, a second pivot point and a spring anchor.

The locking block preferably comprises an overhang for retaining the locking pin therebeneath. The overhang preferably comprises a pushing face for urging the locking pin away from the locking block whenever the locking pin is not accommodated beneath the overhang.

A first sliding pin preferably passes through the first main plate key slot and is free to slide therein in the direction of the sliding of the door against the box. A second sliding pin preferably passes through the second main plate key slot and is free to slide therein in the direction of sliding of the door against the box. A third sliding pin preferably passes through the third main plate key slot and is free to slide therein in the direction of the sliding of the door against the box.

A first end of a sliding pin retaining spring preferably bears against a peg affixed at the second pivot point. The sliding pin retaining spring is preferably a helical spring wrapped around the spring anchor. The sliding pin retaining spring preferably comprises a second end extensive towards and bearing upon the sliding pins to urge them towards the bottom of the particular ones of the main plate key slots wherein they are free to slide.

The locking block is preferably urged towards the open end of the locking block channel by a helical locking block spring.

The overhang of the locking block, the peg and the sliding pin retaining spring are preferably in the space between the lock cover and the door and at least in part protected by the lock cover protective lip.

A rotating plate is preferably pivoted about the second pivot point preferably on the side of the main plate facing into the box. The rotating plate preferably comprises a first rotating plate key slot a second rotating plate key slot and a third rotating plate key slot where, when the rotating plate is in a first angular position about the second pivot point where the door is closed on the box the first rotating plate key slot exactly aligns with the first main plate key slot, the second rotating plate key slot exactly aligns with the second main plate key slot and the third rotating plate key slot exactly aligns with the third main plate key slot. The first sliding pin preferably passes through the first main plate key slot and the first rotating plate key slot together. The second sliding pin preferably passes through the second main plate key slot and the second rotating plate key slot together. The third sliding pin preferably passes through the third main plate key slot and the third rotating plate key slot together.

The locking pin is preferably rigidly affixed in the rotating plate to move therewith.

The locking mechanism preferably comprises a rotating catch pivoted about the first pivot point within a catch aperture preferably formed in the rotating plate. The rotating catch is preferably urged to rotate by a catch-rotating spring affixed at a first end to the catch and preferably affixed at a second end to a tab on the rotating plate.

The rotating catch preferably comprises a spring arm and a blocking member. The aperture preferably comprises a spring arm rest face, a blocking member rest face and a blocking face. The operation of the blocking member rest face and of the blocking face is preferably enhanced by the inclusion of an aperture pin set in the rotating plate adjacently to both thereof. The locking mechanism is preferably primed by urging the rotating catch against the opposition of the catch-rotating spring until the spring arm engages and is retained by the spring arm rest face. The priming of the locking mechanism is preferably possible only when the rotating plate is in the first preferred angular position. When the lock is opened the rotating plate preferably moves to a second preferred angular position about the second pivot point. When the lock opens the spring arm rest face preferably disengages the spring arm and the rotating catch rotates under the influence of the catch-rotating spring bringing the blocking member into engagement with blocking member rest face. The engagement of the blocking member with the blocking member rest face preferably includes the blocking member engaging the aperture pin. When the lock and door are next closed, the rotating plate preferably is returned to the first preferred angular position. The return of the rotating plate to the first preferred angular position preferably allows the rotating catch to rotate further under the influence of the catch-rotating spring for the blocking member to engage the blocking face. The engaging of the blocking face by the blocking member preferably includes the blocking member engaging the aperture pin, this time from a different side from when it was engaged at the blocking member rest position. The blocking member engaging the blocking face preferably prevents the rotating plate from ever returning to the second preferred angular position thereby preventing the door from being re-opened until the locking mechanism is re-primed.

The first rotating plate key slot preferably comprises a first rotating plate key slot notch for accommodating the first sliding pin when the rotating plate moves from the first preferred angular position to the second preferred angular position. The second rotating plate key slot preferably comprises a second rotating plate key slot notch for accommodating the second sliding pin when the rotating plate moves from the first preferred position to the second preferred position. The third rotating plate key slot preferably comprises a third rotating plate key slot notch for accommodating the third sliding pin when the rotating plate moves from the first preferred angular position to the second preferred angular position. The key is preferably inserted into the void between the lock cover and the door to move the sliding pins adjacent to their respective key slot notches to allow the lock to open. The first sliding pin is preferably positioned by the first key platform adjacently to the first key slot notch. The second sliding pin is preferably positioned by the second key platform adjacently to the second key slot notch. The third sliding pin is preferably positioned adjacently to the third key slot notch by the third key platform.

With the sliding pins adjacently disposed to their respective key slot notches the rotating plate is preferably able to be urged by the lock driving pin, bearing upon an opening face as the door is opened against the box, to rotate the rotating plate into the second preferred angular position, the opening face preferably being integral with the rotating plate.

The locking block, when the locking mechanism is primed, is preferably in a raised position. The primed lock, with the rotating plate in the first preferred angular position, preferably has the locking pin held beneath the overhang of the locking block under the downward urging of the locking block spring to maintain the rotating plate in the first preferred angular position.

When the door is open with the rotating plate in the second preferred angular position the locking block is preferably in a lower position such that the pushing face on the overhang of the locking block bears upon the locking pin to maintain the rotating plate in the second preferred angular position.

As the box is withdrawn from the autoteller the reset pin, which preferably was dropped out of the locking block channel as the door was opened, is preferably re-introduced into the locking block channel to raise the locking block once more into the raised position to allow the rotating plate to be moved back into the first preferred angular position by means of the catch rotating spring after the lock driving pin passes a closing face on the rotating plate, as the box passes by the held door on its way to closure.

When the rotating plate is in the second preferred angular position and the locking pin is held against the pushing face of the overhang of the locking block, the locking pin is preferably held inside the cutaway on the key beneath the first key platform to retain the door firmly on the key to allow the closure of the door by the removal of the box from the autoteller.

The rotating catch preferably comprises an indicator flag bearing preferably different coloured areas preferably visible through further viewing apertures in the fixed and/or rotating plates to provide indication of the state of priming of the locking mechanism.

The key preferably provides that each sliding pin can be placed at any one of a predetermined plurality of levels. The appropriate key notch can be placed at the level corresponding to the platform of the key it is desired to use. At all other levels the rotating plate key slots preferably comprise holding notches able to accomodate the sliding pins to allow a limited rotation of the rotating plate, insufficient to bring it to the second preferred angular position to open the door, to relieve sliding stresses otherwise experienced by the sliding pins upon insertion into the lock of an incorrect key and forcing of the box onto the key.

The invention is further explained, by way of an example, by the following description in conjunction with the appended drawings, in which;

DETAILED DESCRIPTION OF THE PREFERRED EMBODIMENT

Figure 1:
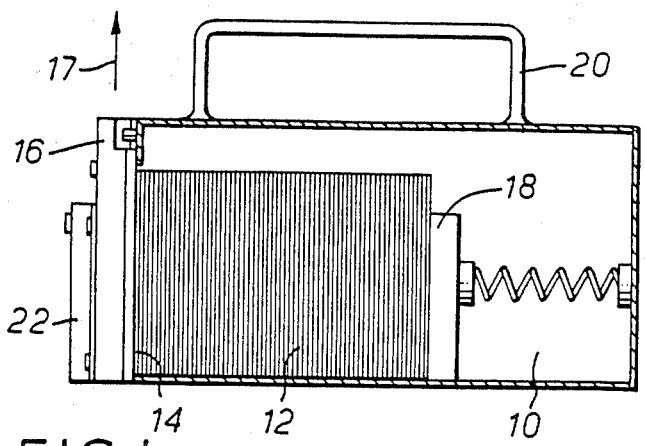
FIG. 1 shows a cross-sectional view of the cassette.

FIG. 1 shows a cross sectional view of the cassette of the preferred embodiment.

The cassette comprises a box 10 wherein a stack of banknotes 12 is urged towards an opening 14 behind a door 16 by means of a spring loaded shoe 18. The door 16 can be slid against the box 10 in the direction of the arrow 17 to reveal the opening 14 and allow access to the banknotes 12.

The box 10 comprises a handle 20 for transporting the cassette. The door 16 comprises a lock 22 for acting against the box 10 for keeping the door 16 closed.

Figure 2:
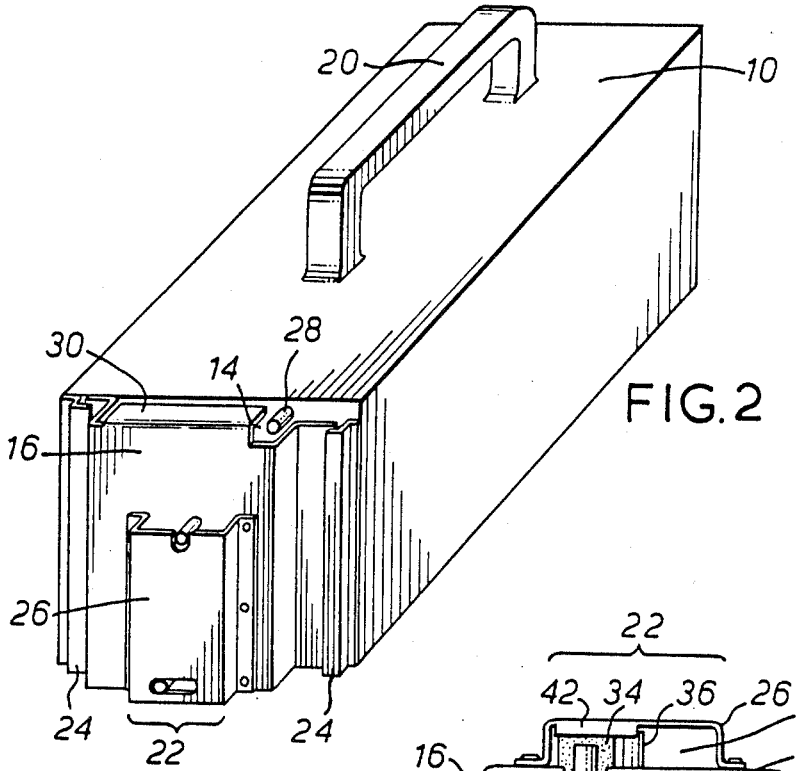
FIG. 2 shows an isometric view of the cassette.

FIG. 2 shows an isometric view of the cassette.

The door 16 is constrained to slide against the end of the box 10 wherein the opening 14 is situated by a pair of slide guides 24. The lock 22 is protected by a lock cover 26 affixed to the outside of the door 16 at the lower edge thereof. The box 10 has affixed thereto a lock driving pin 28 for interacting with the mechanism of the lock 22 as the door 16 slides open on its guides 24. An upper protective lip 30 is provided at the upper edge of the door 16 to prevent interference with those parts of the lock mechanism behind the door 16.

Figure 3:
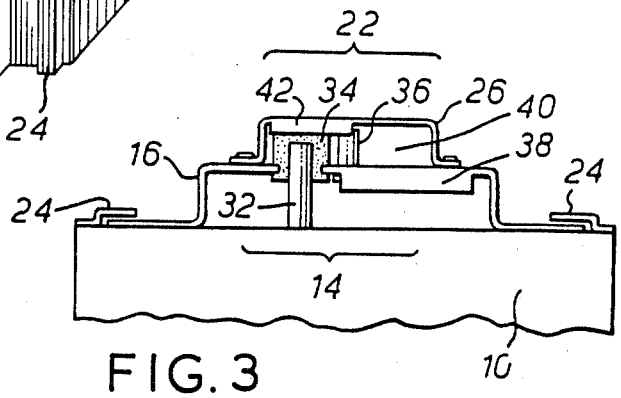
FIG. 3 shows a view from below of the door and lock of FIGS. 1 and 2.

FIG. 3 shows the door 16 and the lock 22 viewed from below.

A reset pin 32 is affixed to the lower edge of the box 10 beneath the lock 22 and is operative to bear upon a locking block 34 in the lock, in a manner to be described, as the door 16 is closed, to raise the locking block 34 into an upper position for preventing the re-opening of the door 16.

Co-operative with the locking block 34 is a locking pin 36 free to slide over a limited side-to-side range within the lock 22 and interactive with the locking block 34 to allow the opening or to prevent the re-opening of the door 16. Its exact manner of operation is described later.

The door 16 comprises a lower protective lip 38 on the lower edge of the door 16 for preventing interference with those parts of the lock mechanism housed at the lower end of the space between the door 16 and the box 10 and also usable as a rest for pushing against the door 16 with a key, in a manner later described, for sliding the door 16 against the box 10.

The lock cover 26 and the door 16 form between them a void 40 at the end therebetween remote from the locking block 34 for the insertion of the key to operate the lock 22. A lock cover protective lip 42 on the lock cover 26 protects the area of the locking block 34 from interference and further acts to retain the locking block 34 from total egress from its position in the door 16 when not engaging the reset pin 32.

Figure 4A:
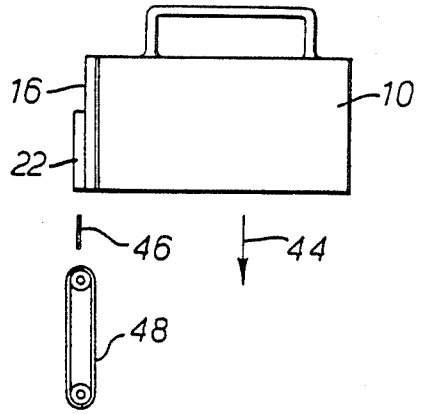
FIG. 4A shows the cassette about to be placed upon the key.
Figure 4B:
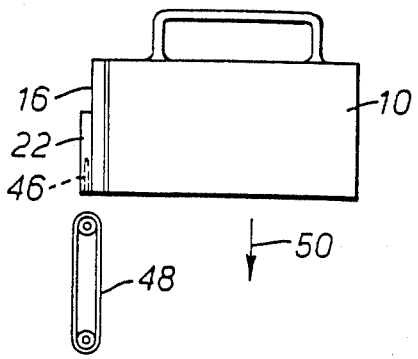
FIG. 4B shows the cassette placed upon the key.
Figure 4C:
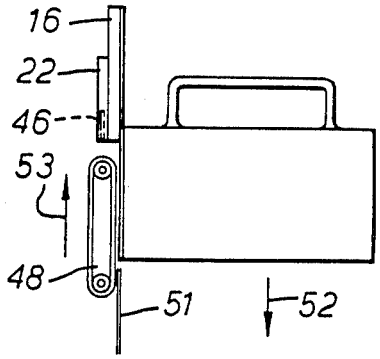
FIG. 4C shows the cassette fully inserted into the autoteller with the door open and access being provided to the money contained therein.

FIGS. 4A to 4C show, in general outline, the sequence of events involved in the use of the cassette.

In FIG. 4A the box 10 is shown about to be lowered in the direction of the arrow 44 onto a key 46. The key 46 is in fact positioned rigidly within the autoteller. It is not important to the present invention exactly how the box 10 is introduced into the autoteller, nor is it important to the present invention what the exact nature of the autoteller may be. In general terms the autoteller will be provided with a door which can be opened to allow access to the cassette position. Thus, the key 46 is rigidly fixed inside the autoteller. Those skilled in the art will be aware of variations wherein the cassette can be provided externally to the autoteller, in which case the key can be affixed to the outside of the autoteller. It is preferred however, for the sake of maintaining the form of the key 46 secret, that the key 46 be secure within the autoteller. Similarly, those skilled in the art will be aware that the box 10 requires to be supported and guided in its positioning within the autoteller, the exact nature of the guiding and support being of no importance to the present invention.

The box 10 is shown in the act of being lowered onto the key 46 such that the key 46 engages the void 40 in the lock 22. Prior to being lowered the lock 22 has been primed. The lock 22 can only be opened by the key 46. A money conveyor 48 is provided beneath the key 46 for moving the banknotes 12 once the door 16 is opened.

FIG. 4B shows the box 10 lowered such that the key 46 rests within the lock 22. At this point the key 46 opens the lock 22. Once the lock 22 is opened the door 16 is free to slide against the box 10. The key 46, being rigidly affixed within the autoteller, supports the door 16 against further downward movement such that, as the box 10 is further lowered, the door 16 stays on the key 46 and slides against the box 10 which can be further lowered in the direction of the arrow 50. The action of the lock mechanism also grabs the key 46 so that the key 46 cannot be removed from the lock 22.

FIG. 4C shows the box 10 fully inserted for the extraction of money 51 by the conveyor 48. The box 10 having moved as far as it can go in the direction of the first arrow 52, has the door 16 fully open. The box 10 has moved down with the door 16 supported on the key 46 to expose the opening 14 to the conveyor 48 which is operable to remove money 51 from the stack 12 of notes by moving its conveyor belt in the direction of the second arrow 53.

Whilst a money conveyor 48 has here been shown for preference, those skilled in the art will be aware that many different types of money-removing device can be used with the present invention with small and obvious modifications to the preferred embodiment shown.

Those skilled in the art will also be aware that the present invention can be used with items other than banknotes, being suitable for the dispensing of coins and other items of value.

When it is desired to remove the cassette, the box 10 is withdrawn in the opposite direction of the arrow 52. The key 46, being held within the lock 22, holds on to the door 16 such that the door 16 closes on the box 10 as the box 10 is withdrawn, meanwhile dis-engaging the conveyor 48 from the opening 14.

Attention is once more drawn to FIG. 4B. When the box 10 is withdrawn in the opposite direction to that of the arrow 50 to the point where the door 16 closes over the opening 14, the lock 22 releases the key 46 such that the lock 22 can be withdrawn from over the key 22 and the key 22 no longer holds the door 16.

Attention is once more drawn to FIG. 4A. As the box 10 completes its being withdrawn in a direction opposite to that of the arrow 44 the key 46 clears the lock 22 leaving the cassette free for total removal from the autoteller.

The lock 22 was primed prior to first use with the key 46. The opening of the lock 22 unprimes the lock 22 such that any subsequent insertion onto the key 46 fails to open the lock 22. Thus the cassette can only be opened on one occasion after each priming. Since the cassette can only be opened by the key 46 affixed within the autoteller and since the door 16, once closed over the opening 14 on the withdrawal of the box 10 automatically locks itself once more, the cassette can only be opened inside the autoteller in its proper position and when withdrawn from the autoteller the residual contents are held secure.

Figure 5:
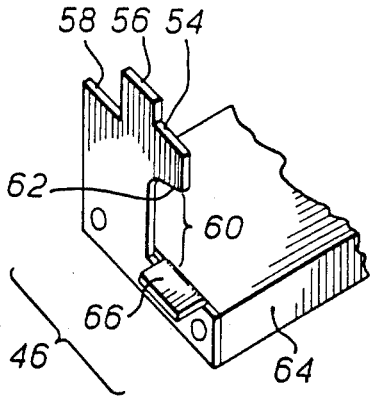
FIG. 5 shows an isometric view of the key.

FIG. 5 shows an isometric view of the key 46. The key 46 comprises a thin metal blade wherein are provided a first key platform 54, a second key platform 56 and a third key platform 58, side by side across the width of the blade, the blade being insertable into the void 40 between the lock cover 26 and the door 16. The first key platform 54 has a cutaway 60 provided thereunder with a holding surface 62 under the first key platform. The whole key 46 is affixed to a bracket 64 inside the autoteller. A key lip 66 is formed in the blade at the base of the cutaway 60, projecting out from the key 46 in the direction of the door 16 for the support of the door 16 subsequently to the insertion of the key 46 into the lock 22. When the key 46 has opened the lock 22 the locking pin 36 of FIG. 3 slides under the holding surface 62 into the cutaway 60, in a manner to be described, to hold the key 46 in the lock 22 by reaction forces against the holding surface 62.

In FIG. 5 there have been shown in preference three key platforms 54 56 58. It will become apparent to those skilled in the art, in consequence of later description, that fewer or more than three platforms 54 56 58 can be used across the width of the key 46.

Each of the key platforms 54 56 58 defines one part of a plural part key combination. Each platform 54 56 58 can be selected at manufacture to be at any one of a plurality of heights from the bottom of the key 46. Thus, if there are M platforms across the width of the key 46 and each platform can be at N heights then there are $M \times N$ different key combinations. Those skilled in the art will be aware that the cutaway 60 can extend beneath more than the first key platform 54 and, where the presence of the cutaway 60 limits the number of different heights available to the platform 54 or platforms 54 56 58 thereover, will be aware of how this will alter the number of available key combinations.

Figure 6:
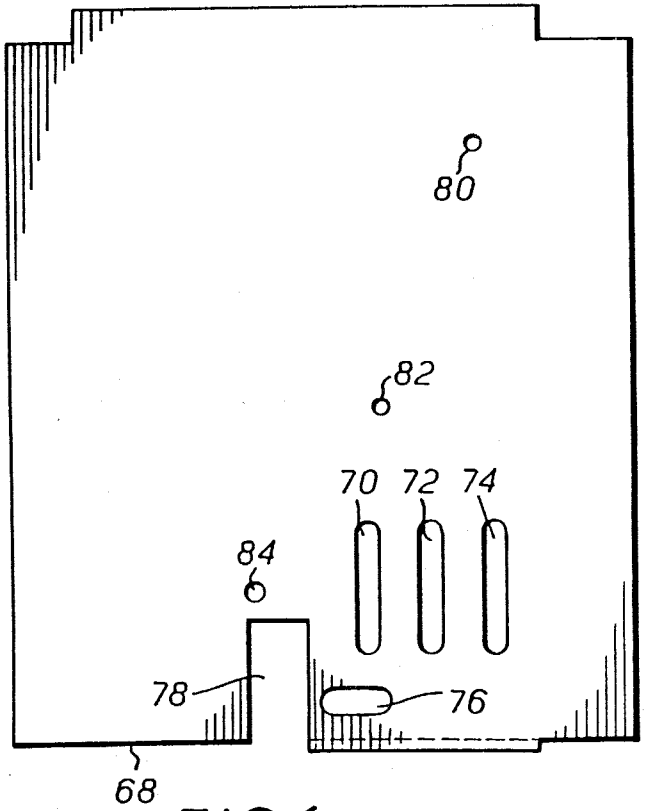
FIG. 6 shows details of the main plate of the door viewed from outside the box.

FIG. 6 shows details of the main plate of the door 16 viewed from outside of the box 10.

The door 16 comprises a strong main plate 68 for holding the components of the lock 22. The main plate 68 is perforated by a first main plate key slot 70, a second main plate key slot 72 and a third main plate key slot 74, the three main plate key slots 70 72 74 being parallel to one another in the direction of sliding of the door 16 on the box 10 and side by side across the door 16 proximate to the lower edge of the door 16 in the lower righthand quadrant thereof.

The main plate 68 further comprises a locking pin slot 76 for accommodating the locking pin 36 and for allowing it a range of movement transverse to the direction of sliding of the door 16 as earlier described. The locking pin slot 76 extends from beneath the first main plate key slot 70, the leftmost one of the key slots 70 72 74, a short distance towards the centre line of the main plate 68.

The main plate 68 has cut into the lower edge thereof a locking block channel 78 wherein the locking block 34 is able to slide over a short range in the direction of sliding of the door 16 against the box 10, the locking block channel being situated to the left of the locking pin slot 76 and of the main plate key slots 70 72 74 and extensive in an upward direction.

The main plate 68 further comprises a first pivot point 80 in the upper right hand quadrant thereof, a second pivot point 82 above the main plate key slot 70 and a spring anchor point 84 proximate to and above the locking block channel 78.

Figure 7:
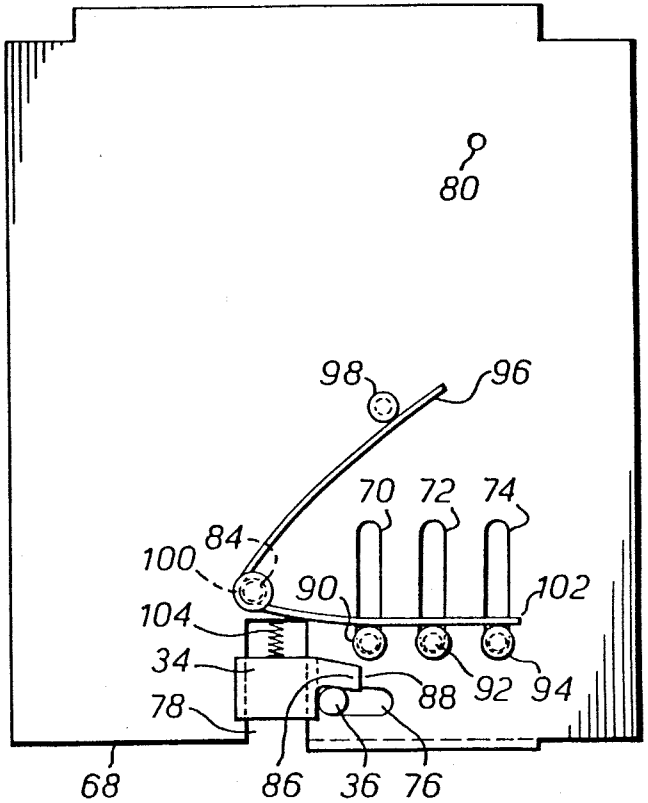
FIG. 7 shows the components of the lock on the outside of the main plate of the door with the lock primed.

FIG. 7 shows the main plate 68 of FIG. 6 with the components of the lock 22 in place, the lock 22 not having the key 46 inserted therein consistently with either the door 16 not yet having been opened after priming or with the door 16 having once more having been locked after withdrawal of the cassette.

The locking block 34 slides within the locking block channel 78 by means of indented guides set in the sides thereof for engaging the edges of the channel 78. The locking block 34 has an overhang 86 extending across the visible side of the main plate 68 and resting on the locking pin 36 sliding in the locking pin slot 76 to maintain the locking block 34 in an upper position. The overhang 86 further comprises a pushing face 88 for use, as will later be described, in maintaining the mechanism of the lock 22 open by causing the locking pin 36 to maintain a position in the righthand side of the locking pin slot 76.

A first sliding pin 90 is provided, free to slide up and down in the first main plate key slot 70. A second sliding pin 92 is provided, free to slide up and down in the second main plate key slot 72. A third sliding pin 94 is provided, free to slide up and down in the third main plate key slot 74. There are as many sliding pins 90 92 94 as there are key platforms 54 56 58 and as many main plate key slots 70 72 74 as there are sliding pins 90 92 94. It will become apparent how the preferred apparatus here described can be modified to accommodate a key having other than three key platforms 54 56 58. Each of the sliding pins 90 92 94 is extensive on both sides of the main plate 68 and held in its respective main plate key slot 70 72 74 by comprising fore and aft sections of a slightly greater diameter than the width of the key slot 70 72 74 together with a central part of a diameter slightly less than that of the key slot 70 72 74 actually in the key slot 70 72 74.

A first end 96 of a sliding spring retaining spring pushes against peg 98 affixed at the second pivot point 82. The sliding pin retaining spring 100 is a helical spring wound around the spring anchor 84. A second end 102 of the sliding pin retaining spring 100 bears upon the sliding pins 90 92 94 to urge them towards the lower ends of their respective main plate key slots 70 72 74. In this instance the sliding pin retaining spring 100 maintains the sliding pins 90 92 94 actually at the bottom of their respective main plate key slots 70 72 74. It is to be appreciated that the action of so urging the sliding pins is maintained, except as later to be described wherever the sliding pins 90 92 94 might be. In those instances to be described where said urging fails, it is to be appreciated that the urging can be maintained by providing that each sliding pin 90 92 94 is provided with its own unique spring, and that the spring can be a compression-opposing or expansion-opposing spring other than of the type already described.

A locking block spring 104 is affixed within the end of the locking block channel 78 and bears down upon the locking block 34 to urge it towards the open end of the locking block channel 78 at the bottom of the main plate 68. The strength of the locking block spring 104 is sufficient to maintain the locking pin 36 beneath the overhang 86 against any force, to be described, urging the locking pin 36 towards the right as seen in FIG. 7, the locking pin 36 being urged in opposition thereto by a slight tilt in the overhang 86 tending, under the force of the locking block spring 104, to urge the locking pin 36 to the left as seen in FIG. 7.

Figure 8:
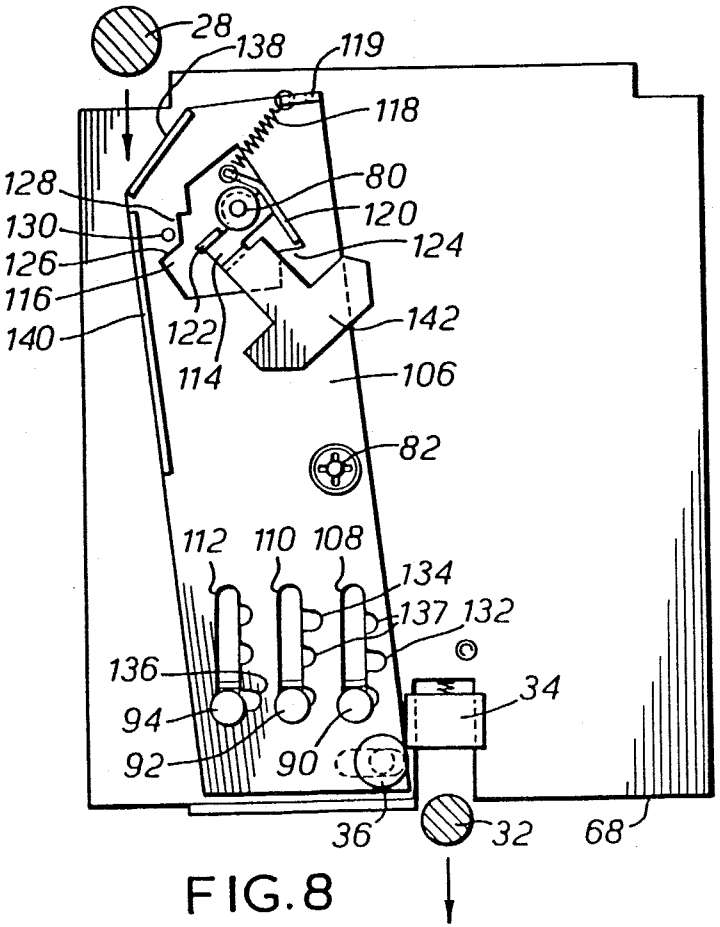
FIG. 8 shows the components of the lock on the inside of the main plate of the door with the lock primed.

FIG. 8 shows the main plate 68 with the components of the lock 22 in position viewed from the inside of the box 10, the lock 22 being in the state of having been primed prior to opening but of not yet having had the key 46 inserted.

A rotating plate 106 is pivoted about the second pivot point 82 and restrained to remain thereon by a spring clip. The rotating plate 106 extends substantially for the entire height of the door 16. The rotating plate 106 is provided with a first rotating plate key slot 108, a second rotating plate key slot 110 and a third rotating plate key slot 112. The first, second and third rotating plate key slots 108 110 112 correspond in size and position with the first, second and third main plate key slots 70 72 74 respectively. FIG. 8 shows the rotating plate 106 in a first preferred angular position, in which position the first, second and third rotating plate key slots 108 110 112 align exactly over the corresponding first, second and third main plate key slots 70 72 74 respectively.

The locking pin 36 is affixed into and moves with the rotating plate 106. When the rotating plate 106 is in the first preferred angular position, as shown in FIG. 8, the locking pin 36 is situated beneath the locking block 34 as illustrated in FIG. 7.

A rotating catch 114 is pivoted about the first pivot point 80 and held thereon by means of a spring clip. The rotating catch 114 operates within a catch aperture 116 which perforates the rotating plate 106. A catch rotating coil spring 118 is affixed at a first end to the rotating catch 114 and at a second end to a catch rotating spring tab 119 on the rotating plate 106 and urges the rotating catch 114, by its attempt to contract, to rotate in a clockwise direction as seen in FIG. 8.

The rotating catch 114 comprises a spring arm 120 extensive in the catch aperture 116 to the right of the rotating catch as seen in FIG. 8. The rotating catch 114 further comprises a blocking member 122 on the left of the rotating catch 114 in the catch aperture 116 as seen in FIG. 8. The rotating catch 114 can take up one of three angular catch positions dependent upon the stage of operation of the lock 22. In FIG. 8 the rotating catch 114 is shown in the first of the catch angular positions where the lock 22 has just been primed, in which position the spring arm 120 rests upon a spring arm rest face 124 in the catch aperture 116. The lock 22 is primed by urging the rotating catch 114 in a counter clockwise direction as seen in FIG. 8 until the spring arm 120 engages the spring arm rest face 124, the elasticity of the spring arm 120 allowing the tip thereof to pass, by deformation, over the edge of the spring arm rest face 124 and subsequently to return onto the main part of the spring arm rest face 124 under the urging of the catch rotating spring 118. The spring arm rest face 124 can more clearly be seen in FIG. 9.

Figure 9:
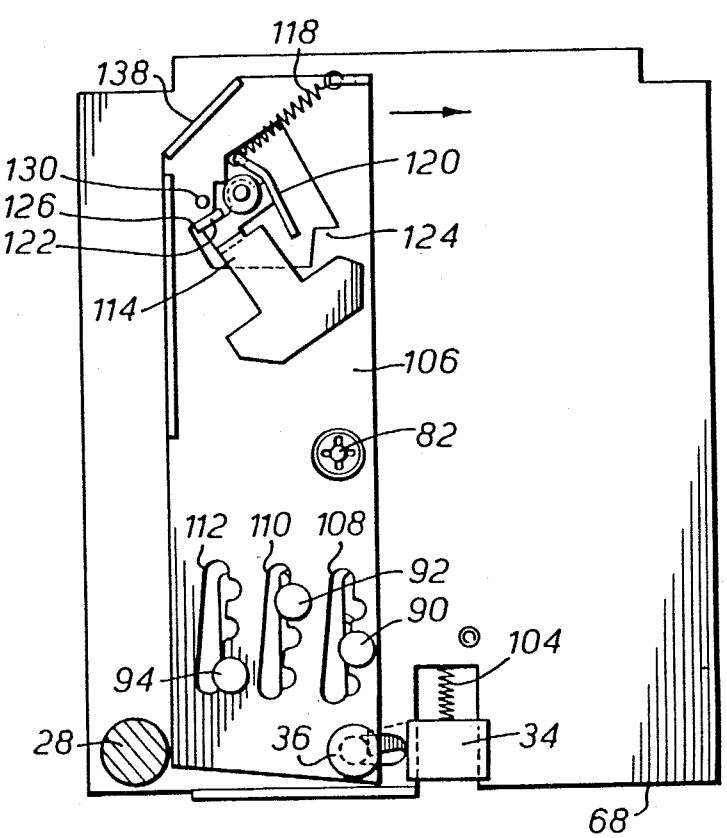
FIG. 9 shows the inside components of the main plate of the door with the door open.

Returning attention to FIG. 8, the catch aperture 116 comprises a blocking member rest face 126. When the rotating catch 114 is in the second angular catch position the blocking member 122 rests against the blocking member rest face 126. This state is achieved only with the rotating plate 106 in a second preferred angular position. The rotating catch 114 having its blocking member 122 resting against the blocking member rest face 126 with the rotating plate 106 in the second preferred angular position is illustrated in FIG. 9.

Figure 11:
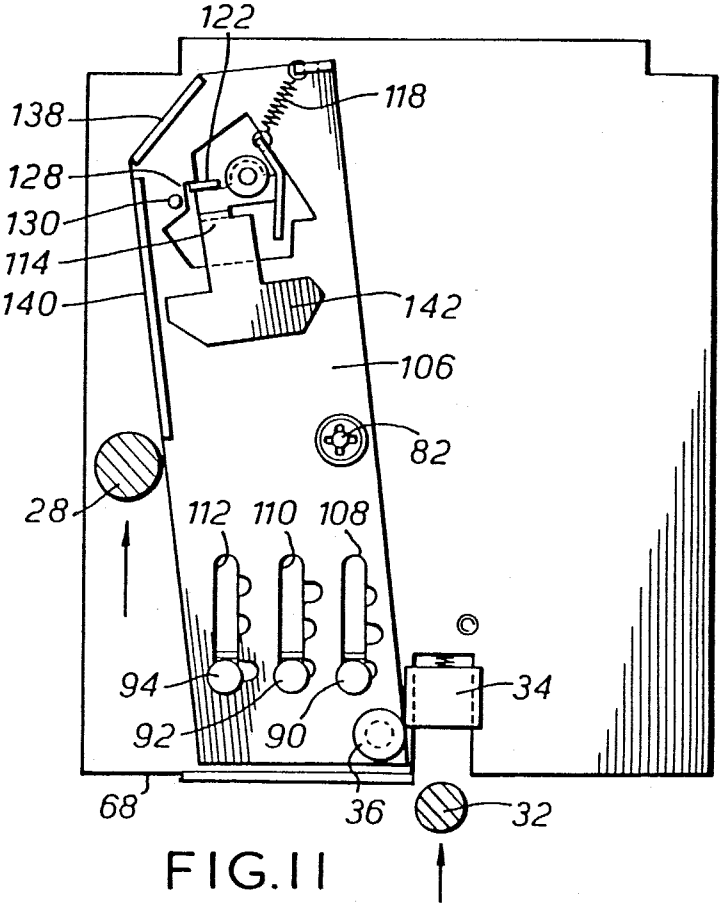
FIG. 11 shows the inside components of the main plate of the door with the door once more closed.

Returning attention once more to FIG. 8, the catch aperture 116 comprises a blocking member blocking face 128. When the rotating catch 14 is in the third angular catch position the blocking member 122 engages the blocking face 128, which can only be achieved with the rotating plate 106 once again in the first preferred angular position. The blocking member 122 engaging the blocking face 128 with the rotating plate 106 in the first preferred angular position is illustrated in FIG. 11.

Returning attention to FIG. 8, the blocking member rest face 126 and the blocking face 128 share a common aperture pin 130 set into the rotating plate 106 proximately to both thereof designed to engage a raised portion of the blocking member 122 to lend strength to the arrangement over and above that which would normally be encountered by the coming together of a thin rotating catch 114 plate and the thin material of the rotating plate 106, thereby adding to the security of the cassette by making the forcing of the lock 22 more difficult.

The first rotating plate key slot 108 comprises a first rotating plate key slot notch 132 set into the righthand side thereof, as viewed in FIG. 8. The first sliding pin 90 passes through both the first main plate key slot 70 and the first rotating plate key slot 108. When the first sliding pin 90 is aligned with the first rotating plate key slot notch 132 it is able to allow the rotating plate 106 to move from the first preferred angular position to the second preferred angular position by rotating counter clockwise as seen in FIG. 8 for the first sliding pin 90 to enter the first rotating plate key slot notch 132 as the rotating plate 106 moves. If the first sliding pin 90 is not aligned with the first rotating plate key slot notch 132 the first sliding pin 90 maintains the first rotating plate key slot 108 in strict registration with the first main plate key slot 70 thereby preventing the rotation of the rotating plate 106 relatively to the main plate 68.

The second rotating plate key slot 110 comprises a second rotating plate key slot notch 134 set into the righthand side thereof as seen in FIG. 8. The second sliding pin 92 passes through both the second main plate key slot 72 and the second rotating plate key slot 110. When the second sliding pin 92 is aligned with the second rotating plate key slot notch 134 it is able to allow the rotating plate 106 to move from the first preferred angular position to the second preferred angular position by rotating counter clockwise as seen in FIG. 8 for the second sliding pin 92 to enter the second rotating plate notch 134 as the rotating plate 106 moves. If the second sliding pin 92 is not aligned with the second rotating plate key slot notch 134 the second sliding pin 92 maintains the second rotating plate key slot 110 in strict registration with the second main plate key slot 72 thereby preventing the rotation of the rotating plate 106 relatively to the main plate 68.

The third rotating plate key slot 112 comprises a third rotating plate key slot notch 136 set into the righthand side thereof as viewed in FIG. 8. The third sliding pin 94 passes through both the third main plate key slot 74 and the third rotating plate key slot 112. When the third sliding pin 94 is aligned with the third rotating plate key slot notch 136 it is able to allow the rotating plate 106 to move from the first preferred angular position to the second preferred angular position by rotating counter clockwise as seen in FIG. 8 for the third sliding pin 94 to enter the third rotating plate key slot notch 136 as the rotating plate 106 moves. If the third sliding pin 94 is not aligned with the third rotating plate key slot notch 136 the third sliding pin 94 maintains the third rotating plate key slot 112 in strict registration with the third main plate key slot 74 thereby preventing the rotation of the rotating plate 106 relatively to the main plate 68.

The first, second and third sliding pins 90 92 94 cooperate such that the rotating plate 106 cannot be moved into the second preferred angular position enabling the door 16 to be opened, as will be described at a later point, unless each of the sliding pins 90 92 94 is aligned with its corresponding rotating plate key slot notch 132 134 136.

The first, second and third key slots 108 110 112 further comprise key slot holding notches 137 set into the same sides thereof as the key slot notches 132 134 136. The key slot holding notches 137 are provided at each possible position, under the influence of the key 46 and having regard to all of the different possible key combinations, for each of the sliding pins 90 92 94, which is not actually the position of a key slot notch 132 134 136. The key slot holding notches 137 provide a purchase between the sliding pins 90 92 94 and the rotating plate 106 preventing their movement relative thereto to strengthen the lock 22 against forcing when the incorrect key is inserted. It is to be appreciated that, whereas there have been shown only three possible sliding pin 90 92 94 positions in the rotating plate key slots 108 110 112, more than or fewer than three such positions can be used and the number of positions corresponds to the number of the plurality of heights of the key platforms 54 56 58 possible in the manufacture of the key 46.

The rotating plate 106 comprises an opening face 138 at the top lefthand corner thereof as viewed in FIG. 8 formed by turning up a lip of the rotating plate 106 material and substantially at forty-five degrees to the direction of the rotating plate key slots 108 110 112. As the door 16 tends towards being opened, always assuming the key 46 is the correct key, the lock-driving pin 28 engages the opening face 138 to slide thereagainst to move the rotating plate 106 from the first preferred angular position to the second preferred angular position.

The reset pin 32, at the same time as the lock driving pin 28 engages the opening face 138, as the door 16 is opened, having been situated beneath the locking block 34 whilst the door 16 was closed in the locking block channel 78, moves from beneath the locking block 34 with the movement of the box 10 relative to the door 16 to allow a subsequent descent of the locking block 34.

The rotating plate 106 further comprises a closing face 140. As the door 16 is once more closed, the lock driving pin 28, now ascending from beneath the edge of the rotating plate 106, engages the closing face 140 and maintains the rotating plate 106 in the second preferred angular position until the lock driving pin 28 clears the mechanism.

The rotating plate 106 is urged to rotate in a clockwise sense as viewed in FIG. 8 by the catch rotating spring 118 which, being attached both to the rotating catch 114 and to the rotating plate 106, serves a double purpose.

An indicator flag 142 is affixed to and rotates with the rotating catch 114. Although not shown in the drawing, it is to be understood that the flag bears different colored areas indicative of whether the rotating catch 114 is in the first, second or third catch angular positions indicatively of the lock being primed, being open, or having once more been closed. The coloured areas are on the underside of the flag 142 as shown in FIG. 8 and are viewed by means of aligned apertures in the rotating plate 106 and the main plate 68 from the outside of the door 16.

FIG. 9 shows the component parts of the the locking mechanism when the door 16 is opened.

Figure 10:
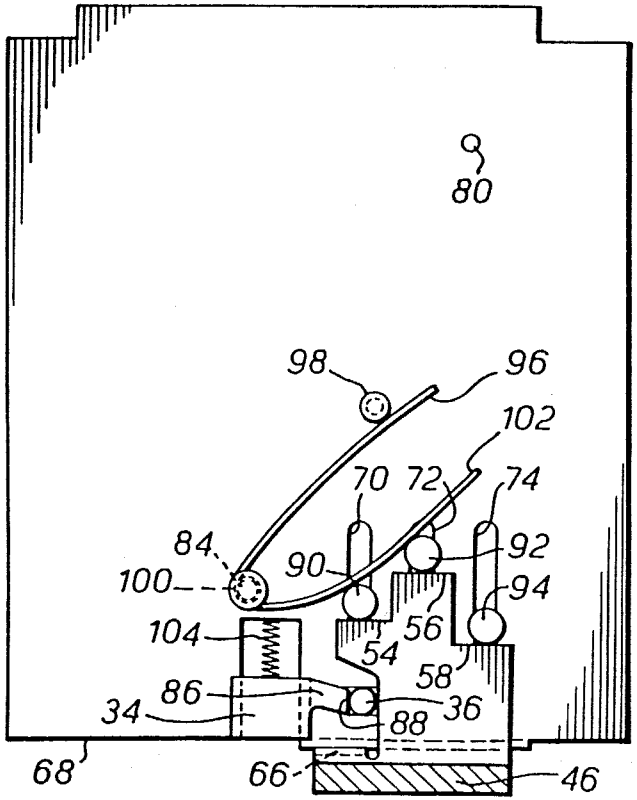
FIG. 10 shows the outside components of the main plate of the door with the key inserted and the door open.

FIG. 10 shows the components of the locking mechanism of FIG. 9 viewed from the outside of the box, FIG. 9 showing those components from the inside of the box. FIGS. 9 and 10 are considered together in the description of the action of the lock since their matter is closely interrelated.

In FIG. 9 the sliding pins 90 92 94 are raised into alignment with their respective rotating plate key slot notches 132 134 136 respectively and respectively in rotating plate key slots 108 110 112 by the action of the key 46.

FIG. 10 shows how the key 46 lifts the first sliding pin 90 on the first key platform 54 into alignment with the first rotating plate key slot notch 132. The key 46 lifts the second sliding pin 92 into alignment with the second rotating plate key slot notch 134 on the second key platform 56. The key 46 lifts the third sliding pin 94 into alignment with the third rotating plate key slot notch 136 on the third key platform 58, the key 46 being inserted until the door 16 rests upon the key lip 66 defining the extent of penetration of the key 46 into the void 40 between the lock cover 26 and the door 16. It is to be appreciated that the whole of the mechanism of FIGS. 7 and 10 is covered by the lock cover 26.

In raising the sliding pins 90 92 94 the key 46 pushes up the second end 102 of the sliding pin retaining spring 100. In the position shown the second end 102 of the sliding pin retaining spring 100 no longer bears against the third sliding pin 94. This does not matter since the third sliding pin 94 is urged towards the third key platform 58 by gravity. As earlier stated, it is also possible to provide each sliding pin 90 92 94 with its own separate spring for urging it towards its appropriate key platform 54 56 58.

In FIG. 9, when the sliding pins 90 92 94 are aligned with their appropriate rotating plate key slot notches 132 134 136 the rotating plate 106 rotates clockwise under the urging of the catch rotating spring 118 for the rotating plate key slot notches 132 134 136 to slide beneath the sliding pins 90 92 94. The rotating plate 106 is further urged to rotate clockwise as seen in FIG. 9 by the lock driving pin 28 pushing against the opening face 138 as the door 16 opens. When the door 16 is fully open the lock driving pin 28 is carried by the box 10 into a position on the lower lefthand side of the door 16 as seen in FIG. 9. At the same time as the lock driving pin engages the opening face 138 the reset pin 32 has exited from the locking block channel 78 to allow a subsequent fall of the locking block 34.

The urging of the rotating plate 106 in a clockwise direction as seen in FIG. 9 brings the rotating plate 106 into the second preferred angular position. As the rotating plate 106 moves it carries with it the locking pin 36, the locking pin 36 moving in the locking pin slot to the left as seen in FIG. 9 and to the right as seen in FIG. 10.

Referring to FIG. 10, the locking pin 36 moves out from beneath the overhang 86 of the locking block 34 to lie in the cutaway 60 of the key 46. If it is subsequently attempted to remove the key 46 the locking pin 36 bears upon the holding surface 62 of the cutaway 60 preventing the removal of the key 46 from the locking mechanism and consequently permitting the door 16 to be drawn once more onto the opening 14 of the box 10 when the cassette is subsequently withdrawn from the autoteller.

With the removal of the reset pin 32 from the locking block channel 78 and the removal of the locking pin 36 from beneath the overhang 86, the locking block 34 is urged by the locking block spring 104 to descend to the bottom of the locking block channel 78. In this position the pushing face 88 of the overhang 86 engages the locking pin 36 and prevents its return in the direction of the locking block 34, thereby preventing the forcible removal of the key 46 from the locking mechanism by holding the locking pin 36 very firmly in place.

Returning to FIG. 9, when the rotating plate 106 moves from the first preferred angular position to the second preferred angular position, the spring arm 120 of the rotating catch 114 disengages the spring arm rest face 124 which moves beyond its range of contact. The rotating catch 114 is then free to rotate in a clockwise sense as seen in FIG. 9 under the urging of the catch rotating spring 118. The blocking member rest face 126, just before the spring arm rest face 124 dis-engages the tip of the spring arm 120, moves with the movement of the rotating plate 106, into the range of engagement with the blocking member 122 of the rotating catch 114. Thus, as the tip of the spring arm 120 clears the spring arm rest face 124 the rotating catch 114 rotates until the blocking member 122 engages the blocking member rest face 126.

When the blocking member 122 is in engagement with the blocking member rest face 126 it rests with its raised part, earlier described, resting against the aperture pin 130. The blocking member 122 engages the blocking member rest face 126 in such a way that the blocking member 122 can still slide thereagainst with subsequent movement of the rotating plate 106. The rotating catch 114 thereby moves from its first angular position, in which position the lock 22 was primed, into the second or intermediate angular position for the catch 114 where the door 16 is open.

FIG. 11 shows the mechanism of the lock viewed from inside the box 10 when the door has been subsequently re-closed and the key 46 removed from the lock 22.

When the mechanism of the lock, viewed from inside the box 10, as is shown in FIG. 11, the mechanism of the lock 22 viewed from outside the box is once again as shown in FIG. 7. These two figures will be referred to together because of the close ties in their material.

In FIG. 11, the box 10 being lifted from the autoteller the lock driving pin 28 engages the opening face 140 and maintains the rotating plate 106 in the second preferred angular position as it is withdrawn, in consequence of the upward movement of the box 10 relative to the door 16 held on the key 46, past the rotating blade 106.

As the lock driving pin 28 clears the opening face 140 the reset pin 32 enters the lower end of the locking block channel 78 and pushes the locking block 34 against the opposition of the locking block spring 104 into an upper position.

With regard to FIG. 7, when the locking block 34 is placed into a raised position the locking pin 36 no longer engages the pushing face 88 of the overhang 86 and is therefore no longer forced to remain in the cutaway 60 of the key 46.

Returning attention to FIG. 11, with the locking pin 36, firmly affixed to the rotating plate 106, free to move, the rotating plate 106 is also free to move. The catch rotating spring 118 urges the rotating plate 106 clockwise as viewed in FIG. 11 to return once more to the first preferred angular position.

In FIG. 7, as the rotating plate 106 moves again into the first preferred angular position, so the locking pin 36, which is firmly affixed thereto, moves once more under the overhang 86 of the locking block 34. The key 46 is thereby released from the door 16 as the door 16 closes. As the key 46 is withdrawn from the door so the sliding pins 90 92 94 return to the bottoms of their respective main plate key slots 70 72 74 and their rotating plate key slots 108 110 112, the two sets of key slots being once more in precise registration one over the other.

Attention is re-drawn to FIG. 11 where, as the rotating plate 106 returns to the first preferred angular position under the influence of the catch rotating spring 118, so the blocking member 122 dis-engages the blocking member rest face 126 by.the relative movement between the blocking member 122 and the blocking member rest face 126 exceeding the depth of the blocking member rest face 126. The rotating catch 114 is thereafter urged to rotate in a clockwise sense as seen in FIG. 11 by the catch rotating spring 118. The rotating catch 114 rotates until the blocking member 122 engages the blocking face 128 of the catch aperture 116 with the raised portion of the blocking member, as earlier described, engaging the aperture pin 130. The rotating catch 114 is therby moved into the third and final catch angular position where the door 16 is locked against any subsequent attempt at re-opening. The blocking member 122 so engages the blocking face 128 and the aperture pin that it is trapped behind the aperture pin 130 preventing any subsequent movement of the rotating plate 106 from the first preferred angular position. Thus, should the key 46 be introduced once more into the lock 22, the lock driving pin 28 will be unable to move the rotating plate 106 via the opening face 138 and will itself be excluded.

The lock as described therefore operates to allow just one opening of the box 10, that opening being within the confines of the autoteller and the subsequent re-locking of the box 10 being automatically achieved upon removal of the box 10 from the autoteller to protect any residual contents.

Any means for providing a re-priming of the lock 22 can be used. Other, secure and lockable means of entry to the box 10 can be provided for both the replenishment of the stack of money 12 and for re-priming the lock 22. An external, key-operated mechanism can be provided on the box or the door for specifically re-priming the lock 22. It is to be appreciated that these parts of the lock mechanism shown in FIGS. 8 9 and 11 would normally be enclosed beneath a protective cover with access for re-priming the lock.

When the door 16 is closed, as illustrated in FIGS. 8 and 11, the door 16 is held shut on the box 10 by the action of the lock driving pin 28 bearing against the opening face 138 of the rotating plate 106. With the rotating plate 106 unable to rotate the combination of the lock driving pin 28 and the opening face 138 form a dead stop preventing the door 16 from being raised on the box 10, in the case of FIG. 8 until a key is inserted and in the case of FIG. 11 until the lock 22 is re-primed.

What is claimed is:

1. A cassette for loading banknotes into a banknote dispenser, said cassette including a door, openable to allow said dispenser access to a stack of banknotes, said door including a primable lock for holding closed said door, said lock, having been primed, being presentable to a key in said dispenser to allow said door to be opened, said lock, upon withdrawal from said key being operable to prevent said door from being opened, and said lock allowing said door to be opened on only one occasion after each instance of priming, said cassette being characterised by said key being a selected one from among a plurality of different keys and by said lock being operable to allow said opening of said door only upon presentation to said selected key.

2. A cassette according to claim 1 characterized by said primable lock comprising a moveable member, operable to be moved, said lock having been primed, from a door-locking position to a door-opening position and by said lock further comprising a priming member, operable to be placed in a first, priming position in contact with said moveable member prior to and permitting of the opening of said door, operable to be moved to an intermediate position when said door is opened for allowing the subsequent movement of said moveable member from said door-opening to said door-closing position, and operable to be moved into a jamming position in the path of movement of said moveable member, upon re-closure of said door, to prevent the return of said moveable member to said door-opening position.

3. A cassette according to claim 2 wherein said moveable member comprises a rotating plate, and wherein said door comprises a main plate, said rotating plate being affixed to rotate on said main plate and said door being affixed to slide on a face of said cassette to be opened and closed, said cassette further comprising a lock driving pin on said face of said cassette, where said door-closing and said door-opening positions include respectively said rotating plate being in first and second angular positions relative to said main plate, where said key is operable to release said rotating plate to rotate from said first to second angular positions, and where, as said door is opened, said lock driving pin is operable to engage said rotating plate to move said rotating plate from said first to said second angular position.

4. A cassette according to claim 3 wherein, upon subsequent re-closure of said door after opening thereof, said rotating plate is urged to return to said first angular position and to remain there until said lock is re-primed and wherein said lock driving pin is then operable to engage said now immovable rotating plate to prevent the opening of said door.

5. A cassette according to claim 2, wherein said face of said cassette comprises a reset pin and said main plate comprises a a locking pin and a locking block, said locking pin being located in and moveable with said rotating plate and being through-penetrative of said main plate to move in an aperture therein, said reset pin being operable to engage said locking block as said door is closed to move said locking block from a first to a second position, said locking block returning to said first position in the absence of engagement with said reset pin and said locking block, when in said first position when said door is open, engaging said locking pin to prevent the return of said rotating plate from said angular position to said first angular position.

6. A cassette according to claim 5 wherein said locking block is operable, when in said second position, said door being closed, to engage said locking pin to urge and allow the passage of said rotating plate from said second angular position to said first angular position.

7. A cassette according to claim 2, wherein said main plate comprises a plurality of main plate key slots, wherein said rotating plate comprises a corresponding plurality of rotating plate key slots, wherein, said rotating plate being in said first angular position, each one of said plurality of rotating plate key slots is in alignment with its corresponding one of said plurality of main plate key slots, wherein said lock comprises a corresponding plurality of sliding pins, each of said plurality of sliding pins being through-penetrative of its corresponding ones of said plurality of main plate key slots and said plurality of rotating plate key slots, and wherein each one of said plurality of rotating plate key slots comprises a key slot notch substantially at ninety degrees thereto for accepting said corresponding sliding pin when it is in alignment therewith, said rotating plate being free to rotate relative to said main plate from said first to said second angular position if and only if each and every one of said plurality of sliding pins is in alignment with its corresponding key slot notch.

8. A cassette according to claim 7 wherein said key comprises a corresponding plurality of key platforms, each at a selected one from a plurality of heights from the base of said key, the combination of selected heights defining said selected one from among said plurality of different keys, where, upon insertion of said key into said lock, each one of said plurality of key platforms engages its corresponding one from among said plurality of sliding pins and urges it towards and positions it adjacently to said corresponding key slot notlch.

9. A cassette according to claim 8 wherein said key further comprises a key lip for the resting of said cassette thereon to define the depth of penetration of said key into said lock.

10. A cassette according to claim 5, wherein said key comprises a cutaway for the entry therein of said locking pin when said rotating plate is in said second rotational position to prevent the withdrawal of said cassette from off said key.

11. A cassette according to claim 3, wherein said priming member comprises a rotating catch affixed to rotate on said main plate and wherein said rotating plate comprises a catch aperture for the rotation of said rotating catch therein, said rotating catch comprising a spring arm for engaging a spring arm rest face of said catch aperture when said rotating catch is in said first position thereof, and further comprising a blocking member, where, as said rotating plate moves from said first angular position to said second angular position said spring arm is freed from said spring arm rest face and said rotating catch is urged into said intermediate position wherein said blocking member prevents further rotation of said rotating catch by engagement with a blocking member rest face of said catch aperture and where, as said rotating plate moves from said second angular position back to said first angular position, said blocking member is freed from said blocking member rest face to allow the further rotation of said rotating catch for said blocking member to engage a blocking face of said catch aperture to prevent the return of said rotating plate from said first angular position to said second angular position until said lock should once more be re-primed by the return of said spring arm to said spring arm rest face.

12. A cassette according to claim 11, wherein said rotating catch comprises an indicator flag, co-rotational therewith and visible through an aperture in said door for indicating, by its position, whether said cassette lock is primed or has been used subsequently to priming.

13. A cassette according to claim 4, wherein said face of said cassette comprises a reset pin and said main plate comprises a locking pin and a locking block, sad locking pin being located in and moveable with said rotating plate and being through-penetrative of said main plate to move in an aperture therein, said reset pin being operable to engage said locking block as said door is closed to move said locking block from a first to a second position, said locking block returning to said first position in the absence of engagement with said reset pin and said locking block, when in said first position when said door is open, engaging said locking pin to prevent the return of said rotating plate from said second angular position to said first angular position.

14. A cassette according to claim 13, wherein said locking block is operable, when in said second position, said door being closed, to engage said locking pin to urge and allow the passage of said rotating plate from said second angular position to said first angular position.

15. A cassette according to claim 14, wherein said main plate comprises a plurality of main plate key slots, wherein said rotating plate comprises a corresponding plurality of rotating plate key slots, wherein, said rotating plate being in said first angular position, each one of said plurality of rotating plate key slots is in alignment with its corresponding one of said plurality of main plate key slots, wherein said lock comprises a corresponding plurality of sliding pins, each of said plurality of sliding pins being through-penetrative of its corresponding ones of said plurality of main plate key slots and said plurality of rotating plate key slots, and wherein each one of said plurality of rotating plate key slots comprises a key slot notch substantially at ninety degrees thereto for accepting said corresponding sliding pin when it is in alignment therewith, said rotating plate being free to rotate relative to said main plate from said first to said second angular position if and only if each and every one of said plurality of sliding pins is in alignment with its corresponding key slot notch.

16. A cassette according to claim 15, wherein said key comprises a corresponding plurality of key platforms, each at a selected one from a plurality of heights from the base of said key, the combination of selected heights defining said selected one from among said plurality of different keys, where, upon insertion of said key into said lock, each one of said plurality of key platforms engages its corresponding one from among said plurality of sliding pins and urges it towards and positions it adjacently to said corresponding key slot notch.

17. A cassette according to claim 16, wherein said key further comprises a key lip for the resting of said cassette thereon to define the depth of penetration of said key into said lock.

18. A cassette according to claim 8 wherein said key comprises a cutaway for the entry therein of said locking pin when said rotating plate is in said second rotational position to prevent the withdrawal of said cassette from off said key.

19. A cassette according to claim 4 wherein said priming member comprises a rotating catch affixed to rotate on said main plate and wherein said rotating plate comprises a catch aperture for the rotation of said rotating catch therein, said rotating catch comprising a spring arm for engaging a spring arm rest face of said catch aperture when said rotating catch is in said first position thereof, and further comprising a blocking member, where, as said rotating plate moves from said first angular position to said second angular position said spring arm is freed from said spring arm rest face and said rotating catch is urged into said intermediate position wherein said blocking member prevents further rotation of said rotating catch by engagement with a blocking member rest face of said catch aperture and where, as said rotating plate moves from said second angular position back to said first angular position, said blocking member is freed from said blocking member rest face to allow the further rotation of said rotating catch for said blocking member to engage a blocking face of said catch aperture to prevent the return of said rotating plate from said first angular position to said second angular position until said lock should once more be re-primed by the return of said spring arm to said spring arm rest face.

20. A cassette according to claim 19 wherein said rotating catch comprises an indicator flag, co-rotational therewith and visible through an aperture in said door for indicating, by its position, whether said cassette lock is primed or has been used subsequently to priming.

* * * * *